US010478956B1

(12) United States Patent
Wheeler

(10) Patent No.: US 10,478,956 B1
(45) Date of Patent: Nov. 19, 2019

(54) METHOD OF EQUIPPING A HAMMER HANDLE WITH A MAGNETIC, NAIL-HEAD RETAINER FOR STARTING A NAIL, AND KIT

(71) Applicant: Markham Wheeler, Strafford, MO (US)

(72) Inventor: Markham Wheeler, Strafford, MO (US)

( * ) Notice: Subject to any disclaimer, the term of this patent is extended or adjusted under 35 U.S.C. 154(b) by 10 days.

(21) Appl. No.: 15/953,788

(22) Filed: Apr. 16, 2018

Related U.S. Application Data

(60) Provisional application No. 62/486,109, filed on Apr. 17, 2017.

(51) Int. Cl.
*B25D 1/06* (2006.01)
*B25G 1/10* (2006.01)

(52) U.S. Cl.
CPC . *B25D 1/06* (2013.01); *B25G 1/10* (2013.01)

(58) Field of Classification Search
CPC ..... B25D 1/06; B25G 1/10; Y10S 7/901
USPC ..... 81/24
See application file for complete search history.

(56) References Cited

U.S. PATENT DOCUMENTS

| | | | | | |
|---|---|---|---|---|---|
| 3,228,720 | A * | 1/1966 | Jordan | B25D 1/06 | 294/65.5 |
| 3,425,468 | A * | 2/1969 | Soucy | B25D 1/06 | 294/65.5 |
| 4,753,138 | A * | 6/1988 | Soucy | B25D 1/06 | 81/24 |
| 4,944,203 | A * | 7/1990 | Miller | B25D 1/00 | 81/24 |
| 5,000,064 | A * | 3/1991 | McMahon | B25D 1/06 | 81/24 |
| 2007/0051208 | A1 * | 3/2007 | Stephens | B25C 3/006 | 81/44 |

* cited by examiner

*Primary Examiner* — Ryan A Reis
(74) *Attorney, Agent, or Firm* — Jonathan A. Bay

(57) ABSTRACT

A method of method of equipping a hammer handle with a magnetic, nail-head retainer for starting a nail includes steps such as follows. A tubular sleeve is produced from tube stock. The tubular sleeve extends between spaced open ends and has a hollow core characterized by an inside diameter. An unequipped hammer handle is bored with a bore hole which extends between an open end and closed end. A magnet is inserted in the bore hole. The tubular sleeve is inserted in the bore hole afterwards to trap the magnet in the bore hole.

19 Claims, 8 Drawing Sheets

METHOD OF EQUIPPING A HAMMER HANDLE WITH A MAGNETIC, NAIL-HEAD RETAINER FOR STARTING A NAIL, AND KIT

CROSS-REFERENCE TO PROVISIONAL APPLICATION(S)

This application claims the benefit of U.S. Provisional Application No. 62/486,109, filed Apr. 17, 2017 and U.S. Provisional Application No. 62/324,419 filed Apr. 19, 2016. The foregoing patent disclosure is incorporated herein by this reference thereto.

BACKGROUND AND SUMMARY OF THE INVENTION

The invention relates to hammers and nails as well as, more particularly, to a magnet insert kit for a hammer handle such that the hammer handle is equipped with a magnetic, nail-head retainer for starting a nail. It is a preference in accordance with the invention that this magnet insert kit in accordance with the invention is particularly advantageous for drywall installers and their drywall hammers.

A further aspect of the invention relates to a method equipping a hammer handle with a magnetic, nail-head retainer for starting a nail.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
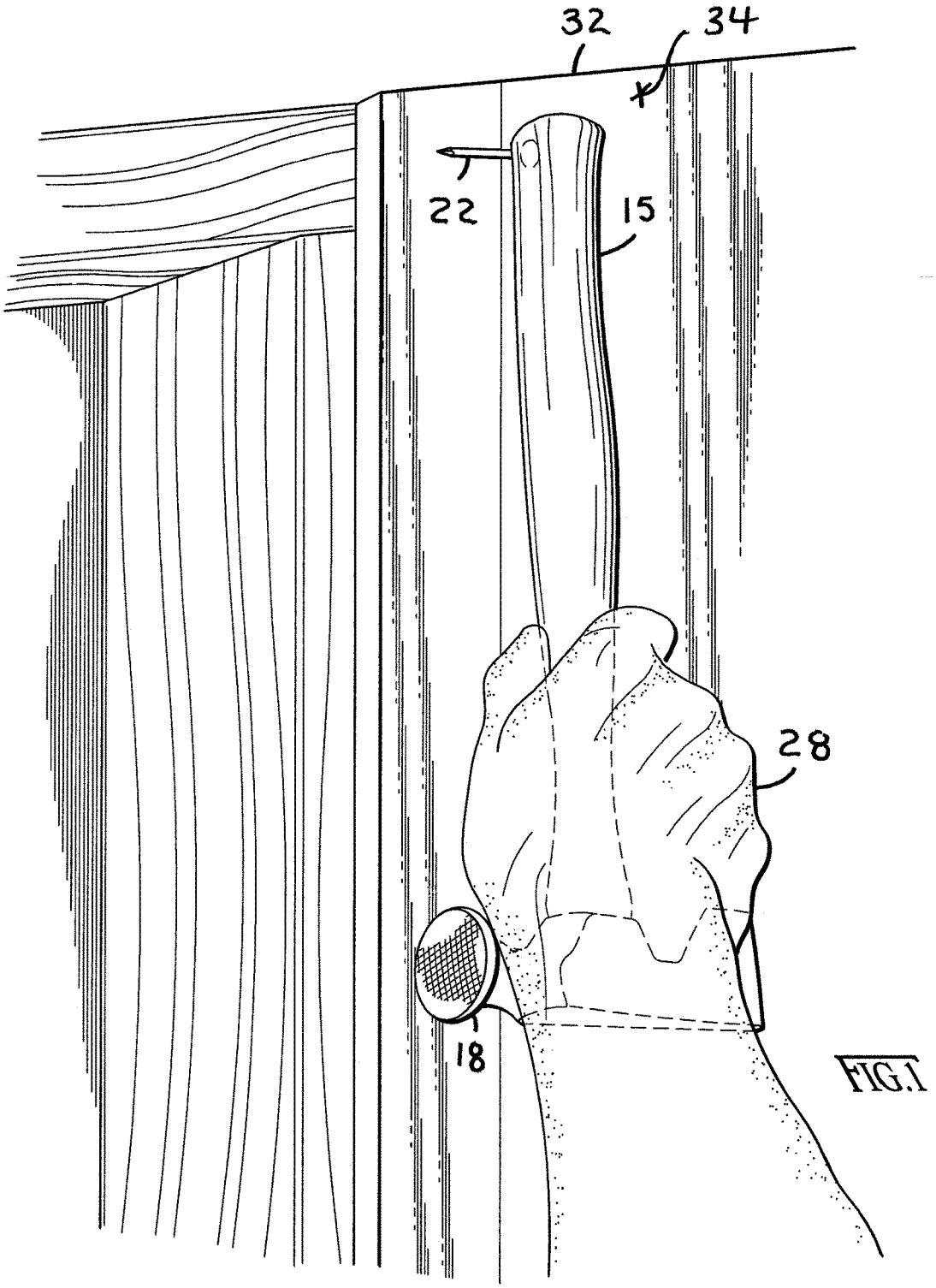
FIG. 1 is a perspective view of a drywall hammer handle equipped with a magnet insert in accordance with the invention by means of a kit in accordance with the invention, wherein a drywall nail, a sheet of drywall and an installer's swinging hand are shown to illustrate an example manner of use.
Figure 2:
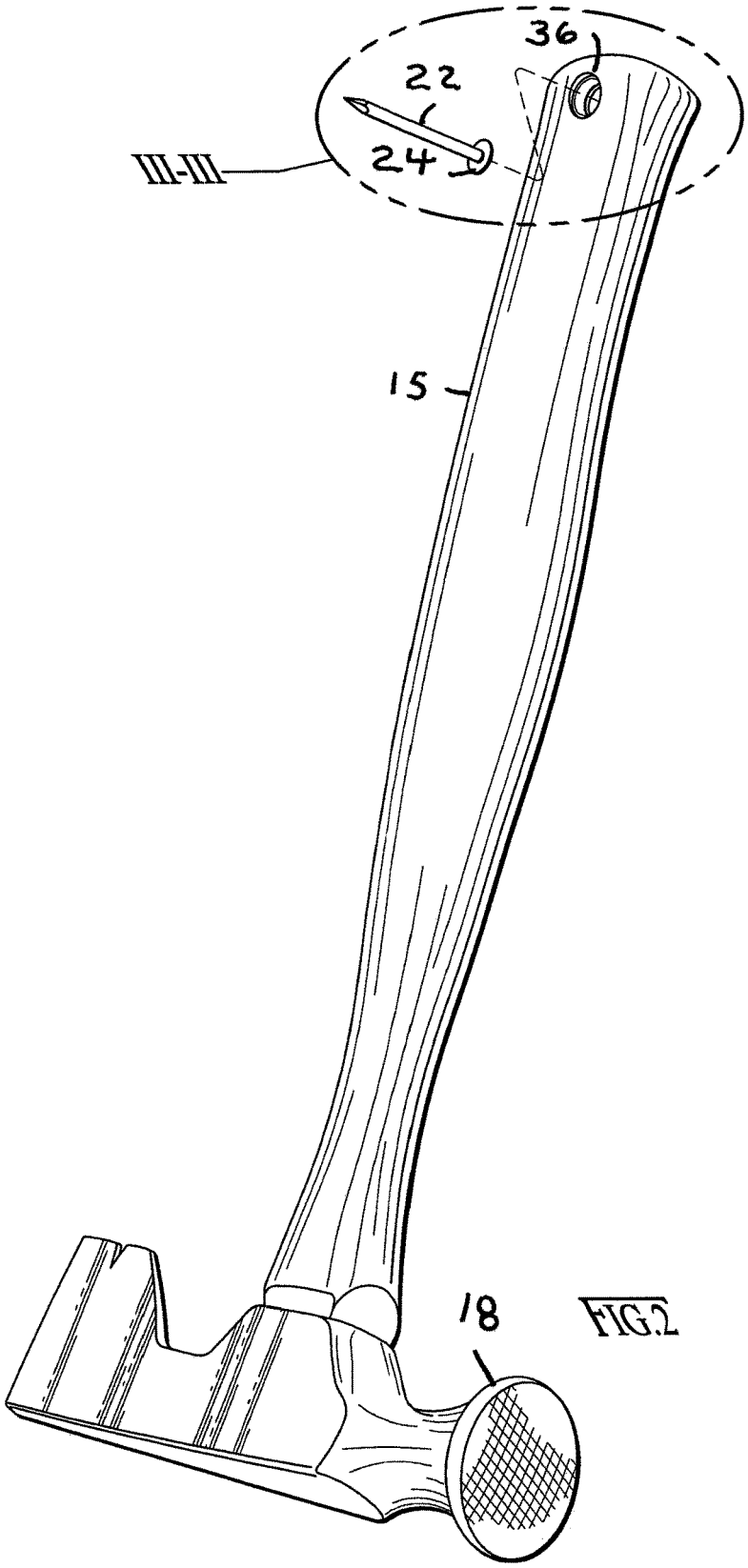
FIG. 2 is a perspective comparable to FIG. 1 except with the drywall hammer spun around, the nail suspended to the side of the magnet insert mounted inside the hammer handle, and the rest of the environmental matter removed from view.

FIGS. 1-3 and 5 show a handle 15 of a drywall hammer 18 equipped with a magnetic nail-head retaining insert assembly 20 in accordance with the invention. The magnetic nail-head retaining insert assembly 20 retains a nail 22 by the head 24 thereof. This is particularly advantageous for a drywall installer 28 to start the starter nail 22 at the top edge 32 of a drywall panel 34, presumably because the drywall installer 28's other hand (not shown) is occupied doing or holding other things.

In fact, the drywall installer is also likely to be simultaneously kicking a foot lift under the bottom edge of the sheet of drywall, and stepping on the foot lift to jam the top edge of the sheet of drywall flush up against the ceiling. Hence, in driving the first series of nails, the drywall installer is pretty much immobilized, with only one free hand available, and otherwise with no feet and nor the other hand available to help with the process.

Figure 4:
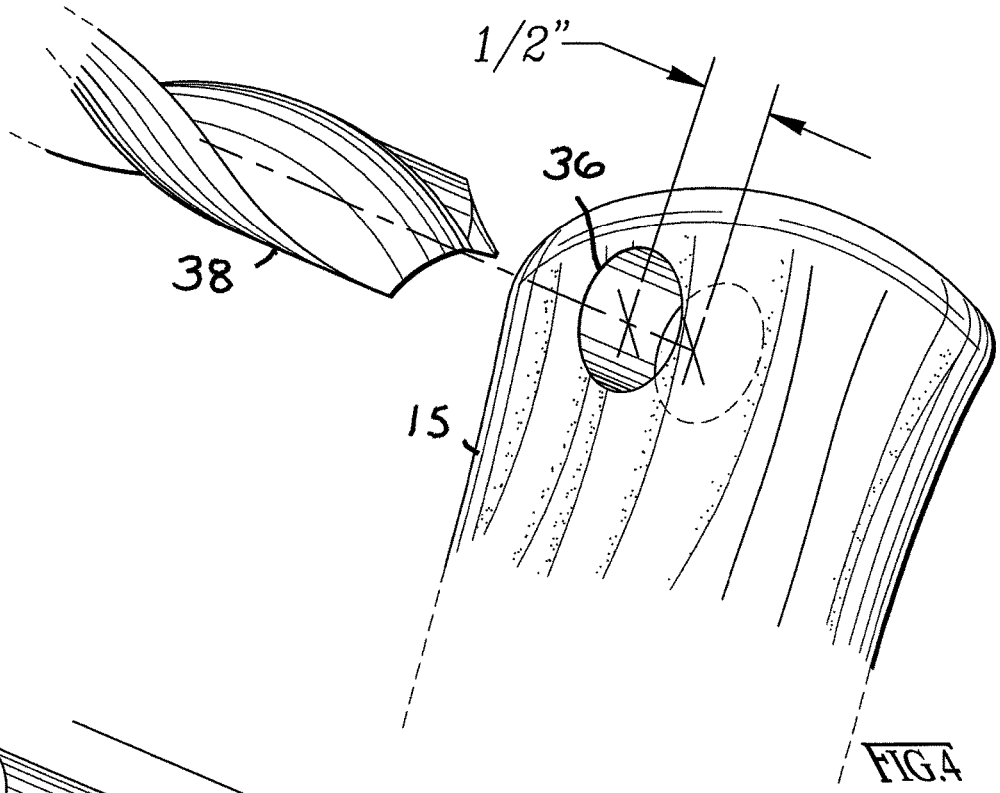
FIG. 4 is a perspective view comparable to FIG. 3 except showing a preliminary step in equipping an un-equipped hammer handle with a bore hole for receiving the magnet insert.

FIG. 4 shows a preliminary step in equipping an un-equipped hammer handle 15 with a bore hole for receiving the magnetic nail-head retaining insert assembly 20. The user (not shown) drills a hole 36 with a ½ inch OD (~1.27 cm OD) drill 38 or so about ½ inch deep (~1.27 cm deep).

Figure 5:
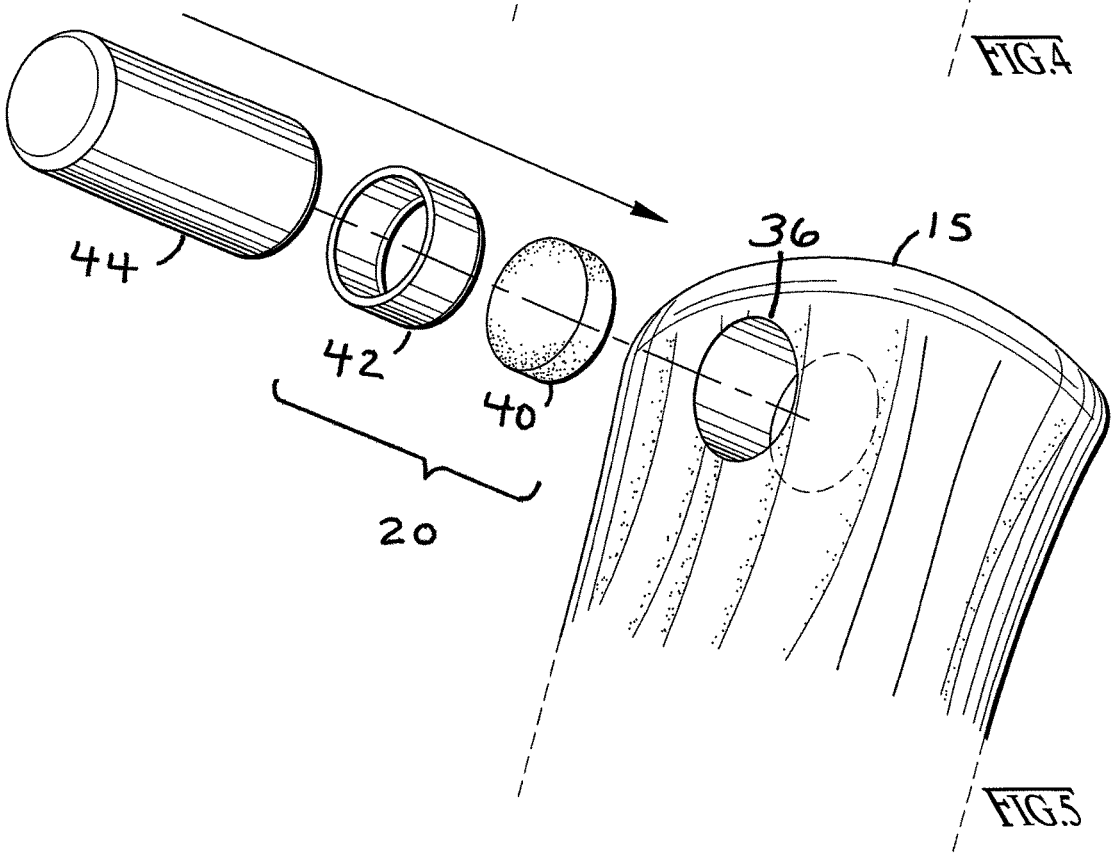
FIG. 5 is a perspective view comparable to FIG. 4 except showing—suspended outside the bore hole in the hammer handle in preparation for insertion therein, from right to left—a magnetic disk, a tubular sleeve, and a driving tool.

FIG. 5 shows a successive step, comprising inserting a magnetic disk 40 and a tubular sleeve 42 more or less permanently into the bore hole 36 by a driving tool 44. Preferably the tubular sleeve 42 is metallic whereas the driving tool 44 can be plastic or any convenient inexpensive material.

Figure 8:
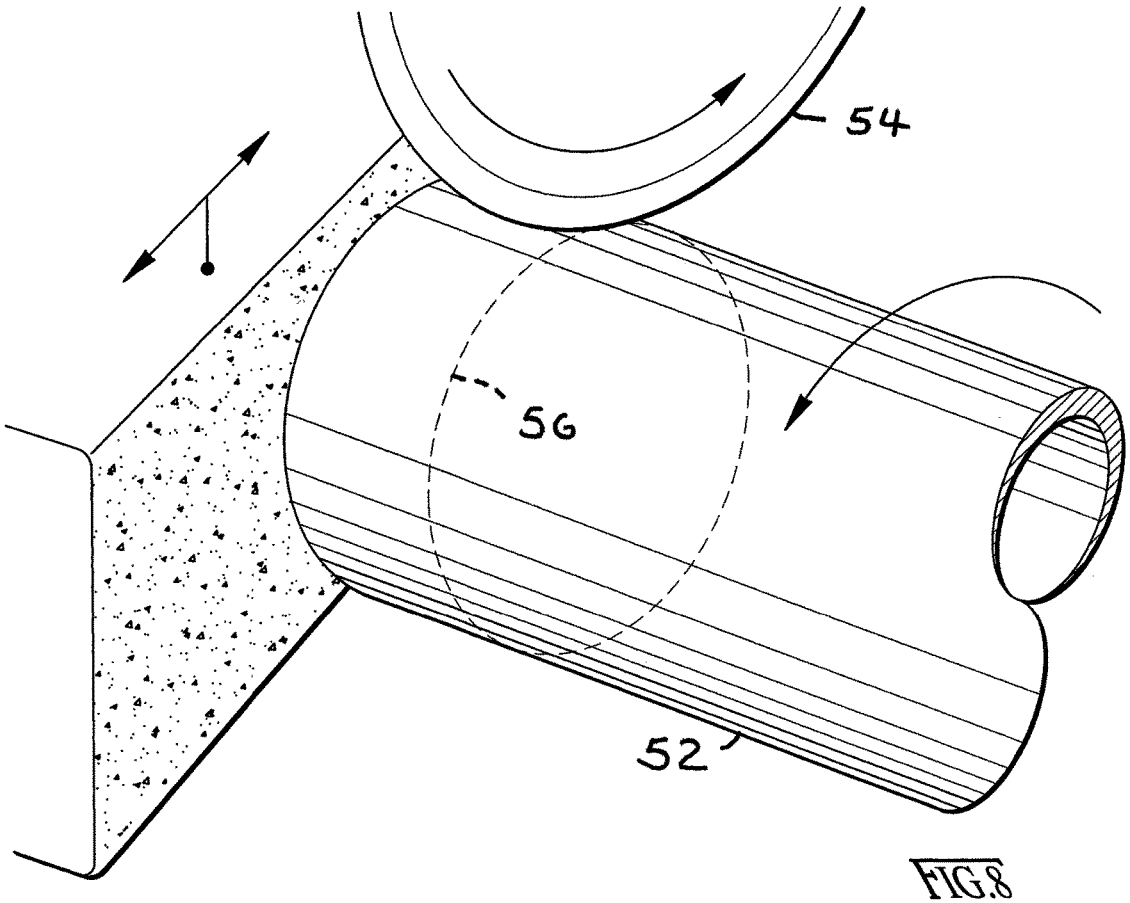
FIG. 8 is a perspective view showing production of the sleeve in accordance with the invention that is shown in FIGS. 5 through 7.

FIG. 8 shows better the production of the metallic tubular sleeve 42. The sleeve 42 is cut off tube stock 52 by a hand-rotated pipe cutter (only the cutting wheel 54 is shown). Preferably the sleeve 42 has about a ½ inch OD (~1.27 cm OD) and is about ⅜ inch (~1 cm) long. Soft metals, especially copper, are very readily cut into such small pieces by such hand-rotated pipe cutters. The plane of the cut is indicated by dashed line 56.

Figure 6:
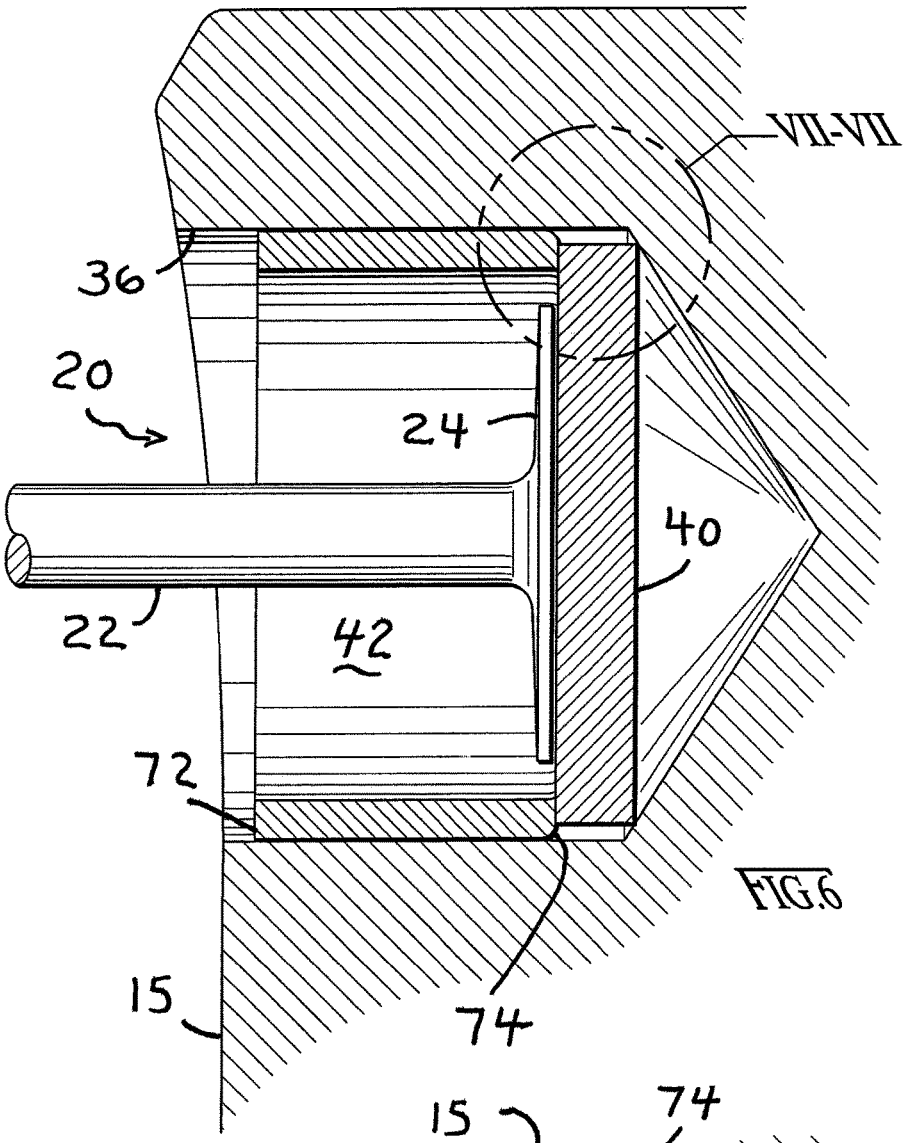
FIG. 6 is an enlarged-scale section view taken along line VI-VI in FIG. 3.
Figure 7:
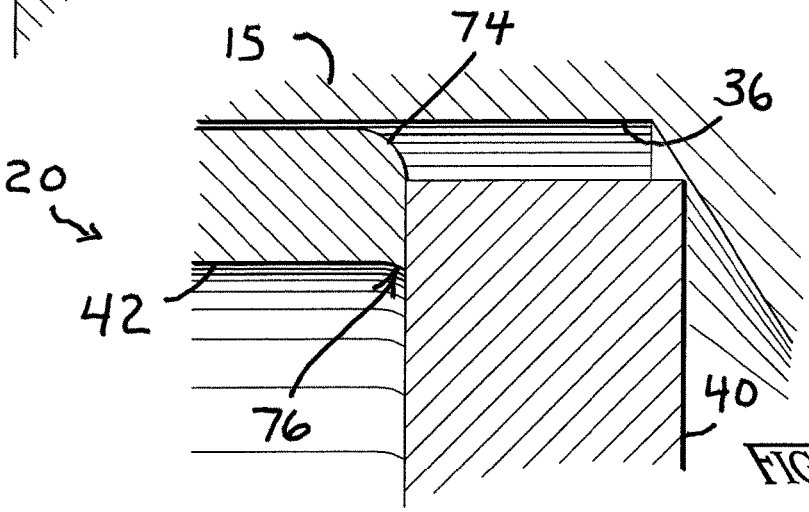
FIG. 7 is an enlarged-scale section view of detail VII-VII in FIG. 6.

As the cutting wheel 54 rolls circumferentially on the dashed line 56 of the outer surface of the tube stock 52, the cutting wheel 54 cuts (and presses into in part) a groove in the tube stock 52 along dashed line 56 (groove not shown). After a certain number of circumferential orbits around the tube stock 52, the tubular sleeve 42 shown in FIGS. 5-7 is produced. FIG. 8 shows that the outboard end 72 of the tubular sleeve 42 is sanded, or deburred and/or flared. Conversely, as better shown in FIGS. 5 and 6, the inboard end 74 of the tubular sleeve 42 is left with its burr 76 intact.

The deburred and/or flared outboard end 72 prevents from catching the nail head 24. The burr 76 on the inboard end 74 helps prevent the nail head 24 from sliding between the inboard end 74 of the tubular sleeve 42 and the magnetic disk 40. Hence both ends of the tubular sleeve 42 are formed to promote a clean ejection of the nail head 24.

Figure 3:
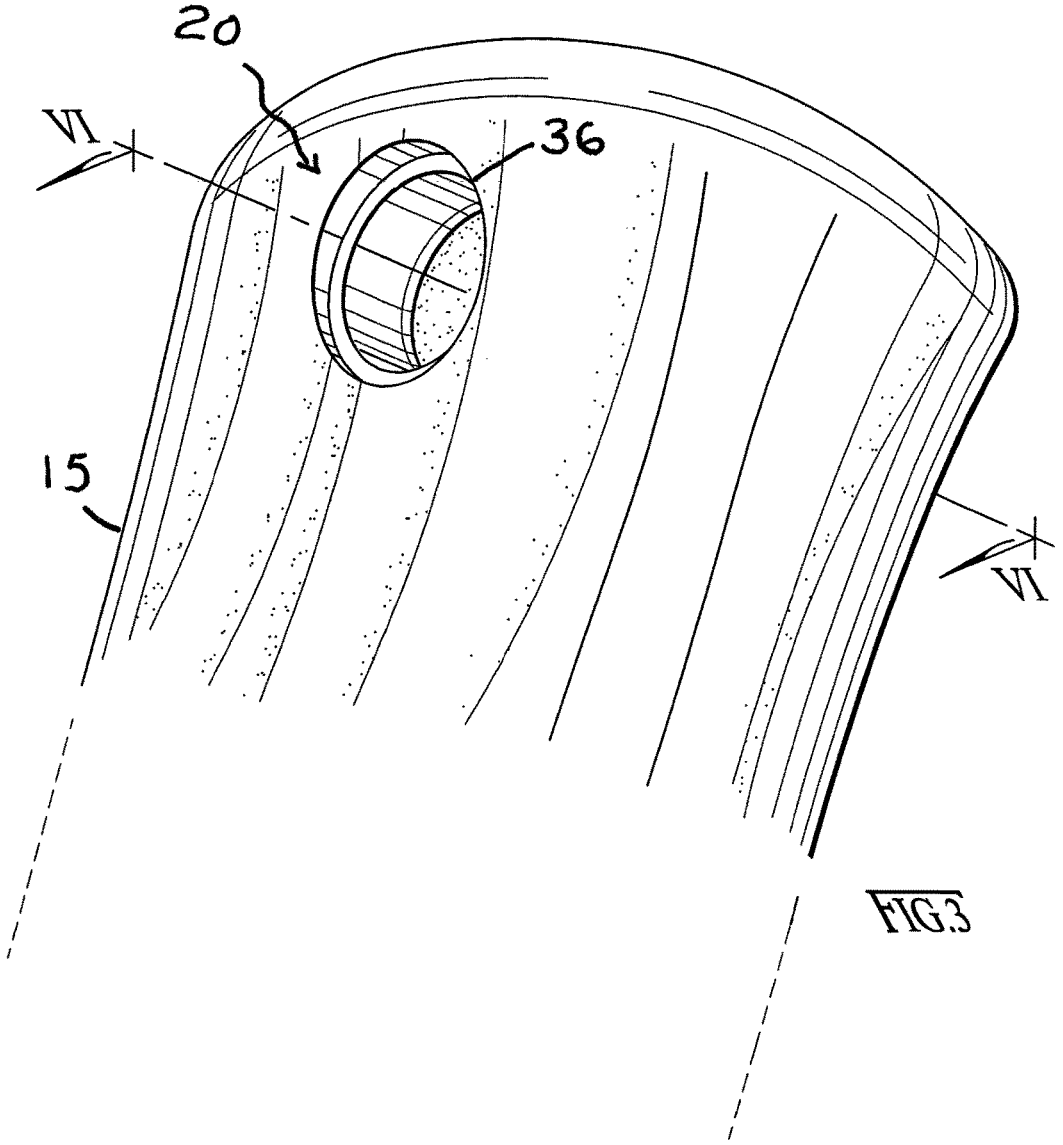
FIG. 3 is an enlarged-scale perspective view of detail in FIG. 2.
Figure 9:
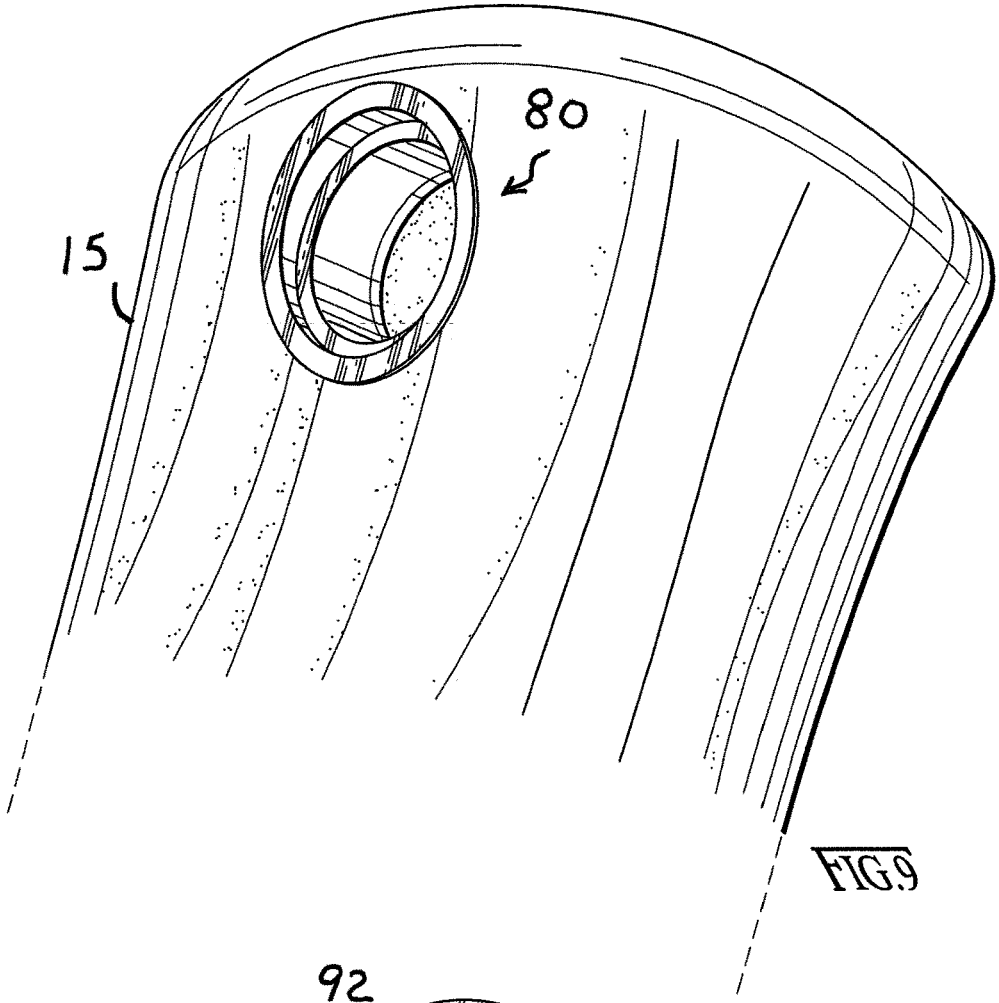
FIG. 9 is a perspective view comparable to FIG. 3 except of an alternate embodiment of the magnetic nail-head retaining insert assembly in accordance with the invention.
Figure 10:
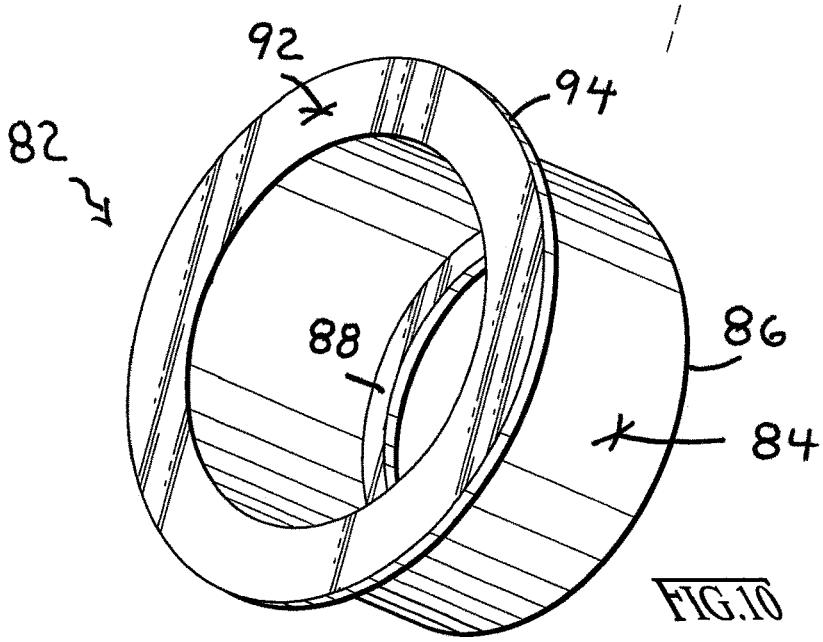
FIG. 10 is an enlarged scale perspective view of an outer sleeve in accordance with the invention which is shown in FIG. 9.

FIG. 9 is a perspective view comparable to FIG. 3 except showing an alternate embodiment of the magnetic nail-head retaining insert assembly 80 in accordance with the invention. FIG. 10 shows better an outer sleeve 82 in accordance with the invention which is shown in FIG. 9. Preferably this outer sleeve 82 is produced of plastic. The outer sleeve 82 has a tubular sidewall 84 extending between an inboard end 86 formed with an inwardly extending flange 88 and an outboard end 92 formed with an outwardly-extending flange 94.

Figure 11:
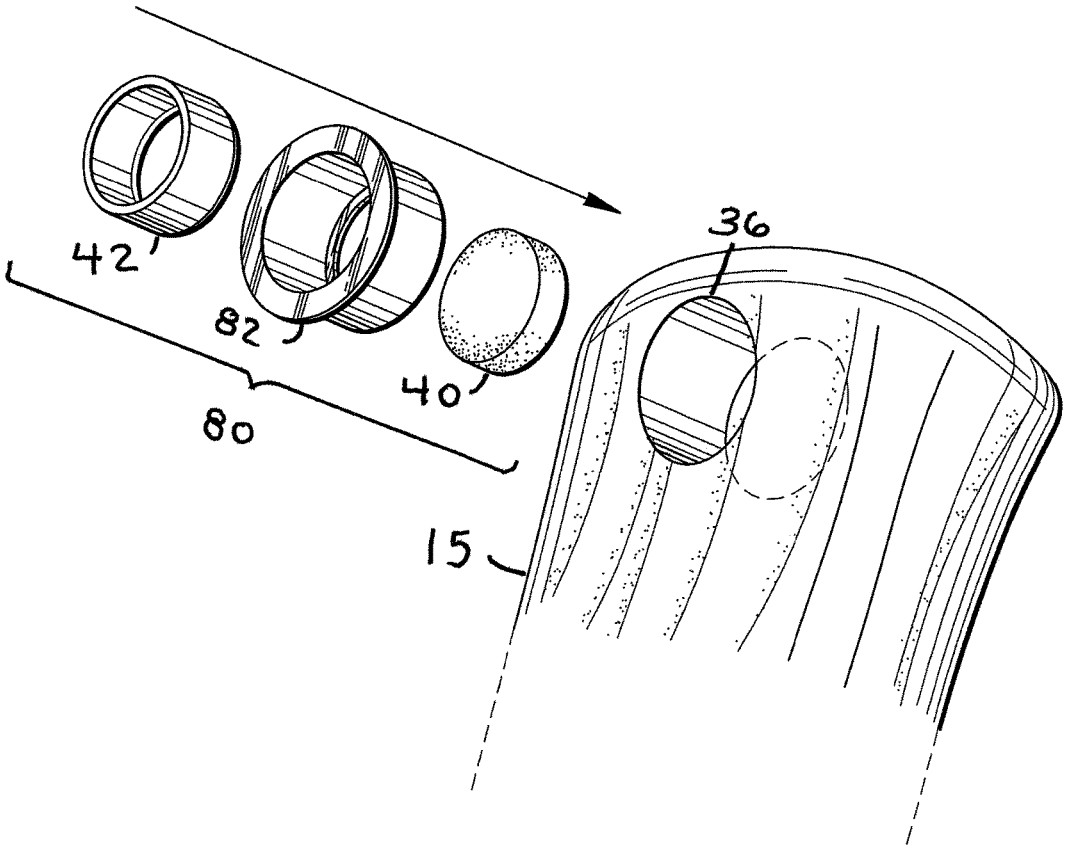
FIG. 11 is a perspective view comparable to FIG. 5 except showing—suspended outside the bore hole in the hammer handle in preparation for insertion therein, from right to left—the same magnetic disk as in FIG. 5, the same tubular sleeve as in FIG. 5 except now that this sleeve is an inner sleeve, and the outer sleeve shown in FIGS. 9 and 10 (wherein the driving tool shown in FIG. 5 has been omitted from the view).

FIG. 11 is a perspective view comparable to FIG. 5 except showing—suspended outside the bore hole 36 in the hammer handle 15 in preparation for insertion therein, from right to left—the same magnetic disk 40 as in FIG. 5, the same tubular sleeve 42 as in FIG. 5 except now that this sleeve 42 serves an inner sleeve 42 for the overall assembly 80, and, the outer sleeve 82 shown in FIGS. 9 and 10 (wherein the driving tool 44 shown in FIG. 5 has been omitted from this view).

If the hole 36 is drilled too big or, if over time, the (inner) tubular sleeve 42 works loose, the (now inner) sleeve 42 can be refitted and things tightened up with this outer sleeve 82. Similarly, if the hole 36 is drilled too deep, the double-flanged outer sleeve 82 serves as a depth gauge for the inner, sleeve 42.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of equipping a hammer handle with a magnetic, nail-head retainer for starting a nail; said method comprising the steps of:

producing a tubular sleeve from tube stock which extends between spaced open ends and which has a hollow core characterized by an inside diameter;

boring an unequipped hammer handle with a bore hole which extends between an open end and closed end;

inserting a magnet in the bore hole; and inserting the tubular sleeve in the bore hole afterwards to trap the magnet in the bore hole;

wherein the step of producing the tubular sleeve further comprises forming one of the open ends with an inward burr or flare; and the step of inserting the tubular sleeve in the bore hole further comprises inserting the tubular sleeve in the bore hole with the one open end that has the inward burr or flare leading.

2. The method of claim 1, wherein:

the magnet comprises a magnetic disk characterized by an outside diameter greater than the inside diameter of the tubular sleeve.

3. The method of claim 1, wherein:

the bore hole is characterized by an inside diameter and the tubular sleeve is characterized by an outside diameter slightly greater than the inside diameter of the bore hole for retention therein by a press fit.

4. The method of claim 1, wherein:

the magnet comprises a magnetic disk characterized by an outside diameter greater than the inside diameter of the of tubular sleeve;

the step of inserting the tubular sleeve in the bore hole further comprises inserting the tubular sleeve so far until the magnetic disk is trapped against the closed end of the bore hole and the inward burr or flare is flush against one face of the magnetic disk.

5. The method of claim 1, wherein:

the step of producing the tubular sleeve further comprises utilizing a rotary pipe cutter to cut both open ends of the tubular sleeve, leaving the one open end with a burr and de-burring or flaring out the other open end.

6. The method of claim 5, wherein:

the step of producing the tubular sleeve further comprises producing the tubular sleeve out of copper tube stock.

7. A method of equipping a hammer handle with a magnetic, nail-head retainer for starting a nail; said method comprising the steps of:

producing an inner tubular sleeve from tube stock which extends between spaced open, ends and which has a hollow core characterized by an inside diameter;

producing an outer tubular sleeve from tube stock which extends between an outboard open end and an inboard open end, and, which also has a hollow core characterized by an inside diameter;

boring an unequipped hammer handle with a bore hole which extends between an open end and closed end;

inserting a magnet in the bore hole;

inserting the outer tubular sleeve in the bore hole; and inserting the inner tubular sleeve in the hollow core of the outer tubular sleeve afterwards to trap the magnet in the bore hole.

8. The method of claim 7, wherein:

the magnet comprises a magnetic disk characterized by an outside diameter greater than the inside diameter of the inner tubular sleeve.

9. The method of claim 7, wherein:

the bore hole is characterized by an inside diameter and the outer tubular sleeve is characterized by an outside diameter slightly greater than the inside diameter of the bore hole for retention therein by a press fit; and the hollow core of the outer tubular sleeve is characterized by an inside diameter and the inner tubular sleeve is characterized by an outside diameter slightly greater than the inside diameter of the hollow core of the outer tubular sleeve for retention therein by a press fit.

10. The method of claim 7, wherein:

the step of producing the inner tubular sleeve further comprises forming one of the open ends with an inward burr or flare; and the step of inserting the inner tubular sleeve in the hollow core of the outer tubular sleeve further comprises inserting the inner tubular sleeve with the one open end that has the inward burr or flare leading.

11. The method of claim 10, wherein:

the step of producing the outer tubular sleeve further comprises forming the inboard open end with an inward flange; and the step of inserting the outer tubular sleeve in the bore hole further comprises inserting the outer tubular sleeve in the bore hole with the inboard open end leading.

12. The method of claim 11, wherein:

the step of producing the inner tubular sleeve further comprises utilizing a rotary pipe cutter to cut both open ends of the inner tubular sleeve, leaving the one open end with a burr and de-burring or flaring out the other open end.

13. The method of claim 12, wherein:

the step of producing the inner tubular sleeve further comprises producing the inner tubular sleeve out of copper tube stock.

14. The method of claim 13, wherein:

the step of producing the outer tubular sleeve further comprises producing the outer tubular sleeve out of copper tube stock.

15. The method of claim 11, wherein:

the flange of the inboard open end of the outer tubular sleeve is characterized by an inside diameter;

the magnet comprises a magnetic disk characterized by an outside diameter greater than the inside diameter of the flange of the inboard open end of the outer tubular sleeve;

the step of inserting the outer tubular sleeve in the bore hole further comprises inserting the outer tubular sleeve so far until the magnetic disk is trapped against the closed end of the bore hole and the inward flange of the inboard open end is flush against one face of the magnetic disk.

16. A method of equipping a hammer handle with a magnetic, nail-head retainer for starting a nail; said method comprising the steps of:

producing an inner tubular sleeve from tube stock which extends between an inboard open end and an outboard open end, and also which has a hollow core characterized by an inside diameter;

producing an outer tubular sleeve from tube stock which extends between an inboard open end and an outboard open end, and, which also has a hollow core characterized by an inside diameter;

providing a magnet;

boring an unequipped hammer handle with a bore hole;

inserting in the bore hole an assembly comprising the inner tubular sleeve inserted in the outer tubular sleeve with the inboard open end proximate each other as well as the magnet proximate the inboard open ends.

17. The method of claim 16, wherein:

the step of producing the outer tubular sleeve further comprises forming the inboard open end with an inward flange; and the magnet comprises a magnetic disk flush against the inward flange of the inboard open end of the outer tubular sleeve.

18. The method of claim 17, wherein:

the inner tubular sleeve is inserted in the outer tubular sleeve such that the inboard open end of the inner tubular sleeve abuts against the flange of the inboard open end of the outer tubular sleeve.

19. The method of claim 18, wherein:

the outer tubular sleeve is produced from plastic; and the inner tubular sleeve is produced from a non-magnetic metallic material.

* * * * *